United States Patent [19]

Schoen

[11] 4,300,746

[45] Nov. 17, 1981

[54] APPARATUS AND METHOD FOR MANUFACTURING CONCRETE STRUCTURAL MODULES

[75] Inventor: John F. Schoen, Toledo, Ohio

[73] Assignee: Schoen Investments, Inc., Toledo, Ohio

[21] Appl. No.: 33,190

[22] Filed: Apr. 25, 1979

Related U.S. Application Data

[63] Continuation-in-part of Ser. No. 833,169, Sep. 14, 1977, abandoned.

[51] Int. Cl.[3] ..... B28B 7/02; B28B 7/22

[52] U.S. Cl. ..... 249/13; 249/37; 249/129; 249/144; 249/161; 249/165; 249/180

[58] Field of Search ..... 249/13, 37, 38, 40, 249/190, 129, 144, 161, 165, 180

[56] References Cited

U.S. PATENT DOCUMENTS

| | | | |
|---|---|---|---|
| 1,851,399 | 3/1932 | Miller | 249/37 |
| 2,908,063 | 10/1959 | Jones et al. | 249/13 |
| 3,036,356 | 5/1962 | Gruelich | 249/13 |
| 3,446,885 | 5/1969 | Krouss | 249/50 |
| 3,462,908 | 8/1969 | Wysocki | 52/79 |
| 3,558,095 | 1/1971 | McNiel | 249/13 |
| 3,750,366 | 8/1923 | Rich et al. | 52/79 |
| 3,811,646 | 5/1974 | Beasley | 249/144 |
| 3,976,741 | 8/1976 | Lowe et al. | 264/334 |

*Primary Examiner*—John Parrish

*Attorney, Agent, or Firm*—Wilson, Fraser, Barber & Clemens

[57] ABSTRACT

An apparatus and method for producing a plurality of substantially dimensionally identical concrete structural modules. The apparatus facilitates the manufacture of a plurality of low cost molds of high dimensional accuracy which will consequently produce modules of high accuracy which can be interchanged, turned, and either horizontally or vertically assembled. A master pattern of the module having non-porous interior and exterior surfaces is positioned between inner and outer forms, the inner and outer spaces thus created are filled with a cementitious substance forming a mold having inner and outer mold segments with their mold faces formed against the non-porous pattern. The concrete molds are provided with various assembly mechanisms and shipped in matched sets to producers for use as forms in the production of the structural modules.

6 Claims, 10 Drawing Figures

FIG. 2
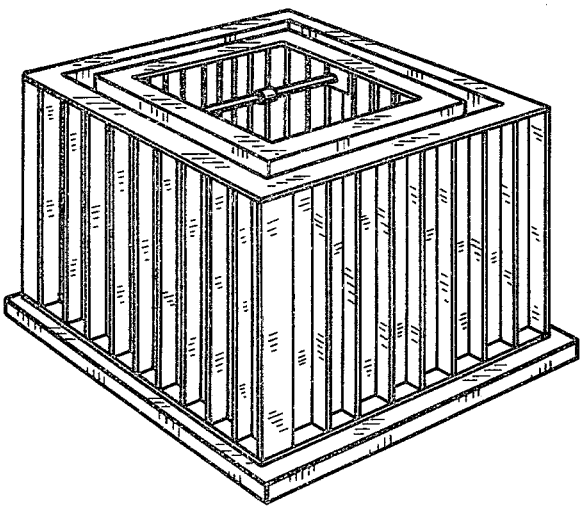
FIG. 3
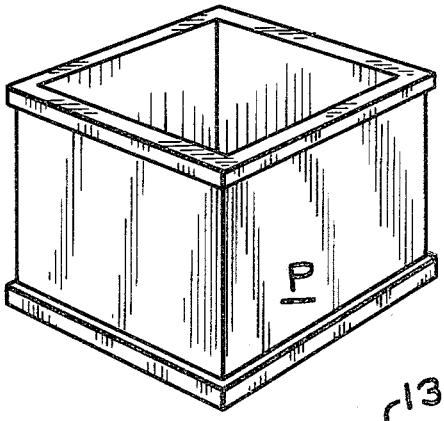
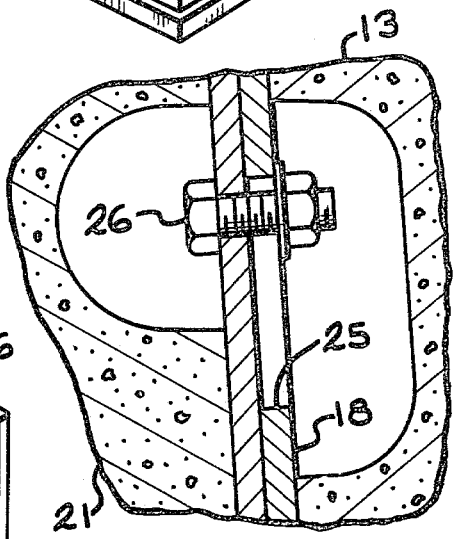
FIG. 8
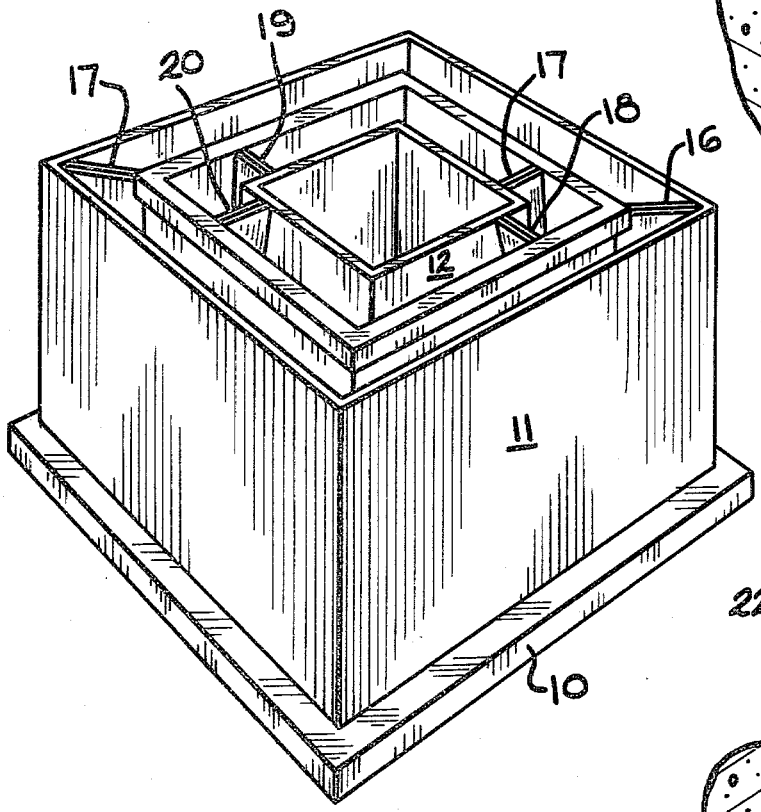
FIG. 4
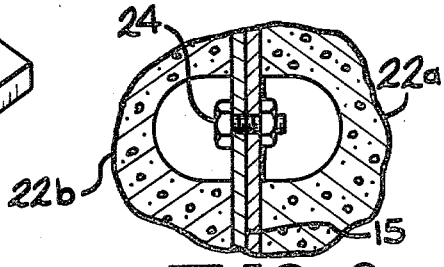
FIG. 9
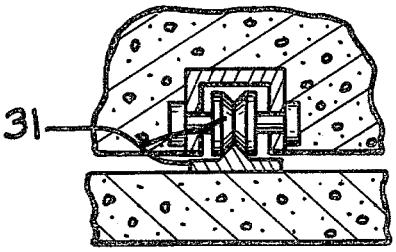
FIG. 10

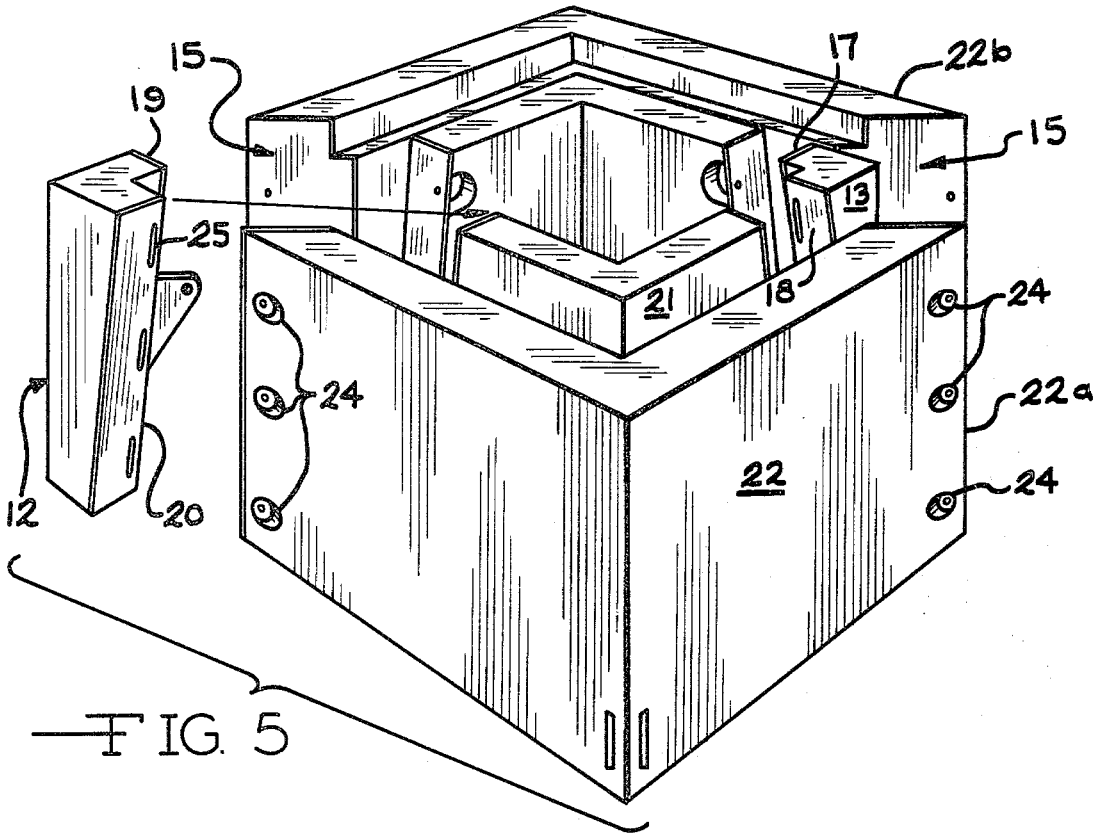
FIG. 5
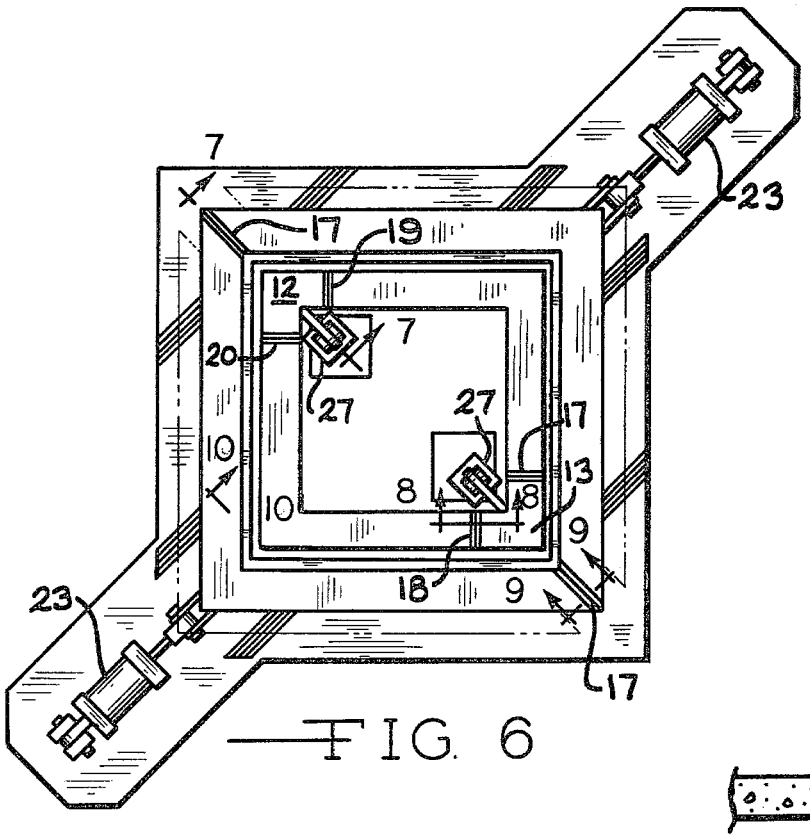
FIG. 6
FIG. 7
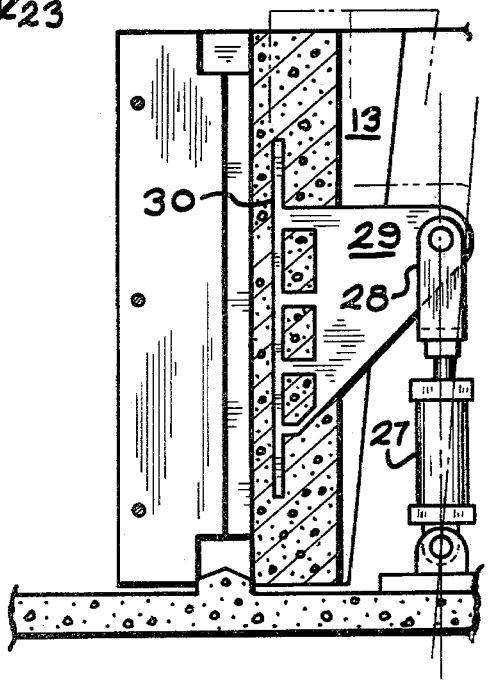

APPARATUS AND METHOD FOR MANUFACTURING CONCRETE STRUCTURAL MODULES

CROSS-REFERENCE TO RELATED APPLICATION

This is a continuation-in-part of my copending U.S. Pat. application Ser. No. 833,169 filed Sept. 14, 1977 now abandoned.

BACKGROUND OF THE INVENTION

This invention relates generally to an apparatus and method for producing a series of dimensionally identical cast concrete structural modules which are used in the construction of multiple unit structures to be used as dwellings, storage, shelters, revetments, institutional buildings and the like. Pre-cast concrete housing modules of a generally hollow cubical or rectangular shape are being increasingly used in the construction industry, due to the fact that the units can be prefabricated away from the point of construction and, if desired, prewired, plumbed or otherwise modified so that the building contractor can quickly assemble the units in the field to provide the desired structure. The advantages of pre-cast concrete modules have been known in the art and are discussed and shown for example, in U.S. Pat. Nos. 3,750,366 to Rich and 3,462,908 to Wysocki.

Since the introduction of such pre-cast modules to the building industry, their use has increased, particularly as on site construction costs have steadily increased throughout the years. However, certain problems encountered with the widespread use of the modules have developed and heretofore have acted as a deterent to their further use. One of the major problems is the fact that transportation costs of a pre-cast module, due to its size and weight, becomes a cost factor in the construction which dictates the desirability of having a number of production sites throughout the country to reduce transportation costs and time, as opposed to one or two centrally located production facilities.

Secondly, production costs for creating and maintaining conventional steel or other forming systems are relatively high, which in effect limits the number of operators which can enter the module production business due to necessary start-up costs. For example, it is estimated that the cost of conventionally fabricated steel forms for a rectangular hollow unit of the type described in this invention, having an approximately ten foot interior opening would be at least $50,000.00; in order to obtain a volume production, a given producer would necessarily have to have a number of such steel forms and the required capital to build or purchase the same.

Thirdly, particularly since the modern trend is to high rise units in which a large number of modules are vertically stacked, dimensional variation from one module to another causes difficulty and in fact often prevents the use of such units because dimensional variations from one unit to another are multiplied as the units become vertically stacked.

Any practical high production application of the pre-cast module concept would require the use of many separate and independent form assemblies and often times independent casting sites and form suppliers as well. With the more conventional form systems used in the industry to date considerable variation in various critical dimensions of concrete module units are experienced. These variations are often caused by dimensional variations between one form assembly and another, and by differences between dimensions enclosed by one particular form assembly set up for one casting operation and the same form assembly set up for another casting operation. Dimensional differences can also be caused by temperature changes, warping or bending of structural members, worn parts and a multitude of other factors. In order to satisfactorily construct a multiple story building of such pre-cast units, it is generally necessary that any dimensional variation from unit to unit, in the type of ten foot units herein described, be limited to very close tolerances. That is, the units must be straight, square, stackable and dimensionally accurate, within, for example, plus or minus 1/8 inch in a ten foot length.

These close dimensional tolerances are especially necessary in large construction projects where modules cast by more than one source or from several separate forms at any one source are necessarily used. As previously stated, it is desirable to have one or more sources for the modules fairly close geographically to the site of the project. Unless the producers of the modules for that project are casting the many individual units from dimensionally identical forms or molds, great difficulty will be encountered by the contractor in assembling the modules from multiple forms or sources due to dimensional variations. The economically impractical alternative to the instant molds, due to the capital requirements, is the conventional system of multiple finished steel molds which increases the contractor's cost and thus the cost to the ultimate project sponsor, public or private.

BRIEF DESCRIPTION OF THE INVENTION

The invention described herein is an apparatus and method for producing a plurality of cast concrete housing modules from multiple mold forms, which modules, because of the method in which the molds were created, maintain accurate dimensional tolerances necessary to build a satisfactory structure. The method enables the production of low cost, identical mold forms which are available to more producers throughout a geographic area, thus reducing transportation costs of the concrete module and creating a healthy competitive market of supply.

The method generally consists of fabricating a negative master mold of finished wood or steel forms within which is cast a positive master pattern. The initial expense of producing only one (or a very limited number) of these master patterns can be prorated over many production units subsequently produced and is another major advantage of this system. The master pattern is preferably finished with a non-porous surface or armor coating, such as with an epoxy sealant, fiberglass reinforced resins, or similar material, so as to preserve the master pattern and provide a product that will require little finishing. Inner and outer forms are then provided within and surrounding the master pattern for casting a cementitious material such as concrete with suitable reinforcing and release mechanisms within the spaces between the inner and outer forms and the master pattern and hardening the same to provide inner and outer molds whose molding faces have been defined by the accurate master pattern.

When the inner and outer mold forms are then removed from the positive master pattern, they can be reassembled and used to cast production concrete modules. Before use as production mold forms they may be finished with a non-porous surface or armor coating, such as with an epoxy sealant, fiberglass reinforced resins, or similar material, so as to preserve their surface uniformity and dimensional integrity and provide a product that will require little finishing. Because the state of the art of concrete modules has advanced to the extent that certain lateral projections, particularly on the outer surfaces thereof, are used for stacking purposes, for reinforcement and for providing duct ways for plumbing, electrical conduit and the like, as pointed out in the aforementioned issued U.S. patents, such lateral projections necessitate the utilization of an outer mold form having means for removing it from the master pattern and projections or the ultimate production units being cast. In addition, the inner mold must be and is designed to be reduced dimensionally subsequent to casting operation so as to allow the finished cubical product to be withdrawn after having eliminated significant pressures created by the casting operations even though the inner faces of the master pattern and production modules are generally planar. The following specification describes a preferred embodiment of the invention, showing the details in which the inner and outer concrete mold forms are fabricated to facilitate their use as form molds in the production of such concrete modules by overcoming many of the major problems encountered in more conventional and customary systems of forming.

It is accordingly an object of this invention to provide an apparatus and method which enables the production of a large number of dimensionally identical concrete structural modules from a plurality of low cost concrete mold forms, each of the concrete mold forms having the dimensional accuracy required to produce products which can be used in a building project of multiple stories and virtually unlimited horizontal dimensions.

It is another object of this invention to provide an apparatus for the casting of concrete modules which can be readily afforded by a number of both small and large producers and which contains features enabling its use as a production mold form.

Other objects and advantages of the invention will be apparent to those skilled in the art from the following detailed description of a preferred embodiment thereof.

BRIEF DESCRIPTION OF THE DRAWINGS

FIG. 2 is a view in perspective of a conventional steel or other type fabricated form for production of an unfinished concrete housing module of the type illustrated herein;

FIG. 3 is a view in perspective of a master pattern of a typical concrete housing module of a type to be produced by the method and apparatus of this invention;

FIG. 4 is a view in perspective of inner and outer forms shown in position surrounding the master pattern as it is shown in FIG. 3;

FIG. 5 is a view in perspective, partially exploded, showing the inner and outer concrete mold forms produced by the apparatus of FIG. 4;

FIG. 6 is a plan view showing the inner and outer standard production mold forms in casting position as they would be used by a producer of concrete modules;

FIG. 7 is a cross sectional view in elevation, shown on an enlarged scale, of the details of one of the corner sections of the molds, taken along lines 7—7 of FIG. 6; as one of several possible arrangements to accomplish vertical movement at two opposite corners of the internal mold form assembly;

FIG. 8 is a cross sectional view in elevation, taken along line 8—8 of FIG. 6, showing another mold form detail;

FIG. 9 is a cross sectional view in elevation, shown on an enlarged scale, and taken along line 9—9 of FIG. 6; and FIG. 10 is a cross sectional view in elevation, taken along line 10—10 of FIG. 6 and shown on an enlarged scale.

DESCRIPTION OF THE PREFERRED EMBODIMENT

Figure 1:
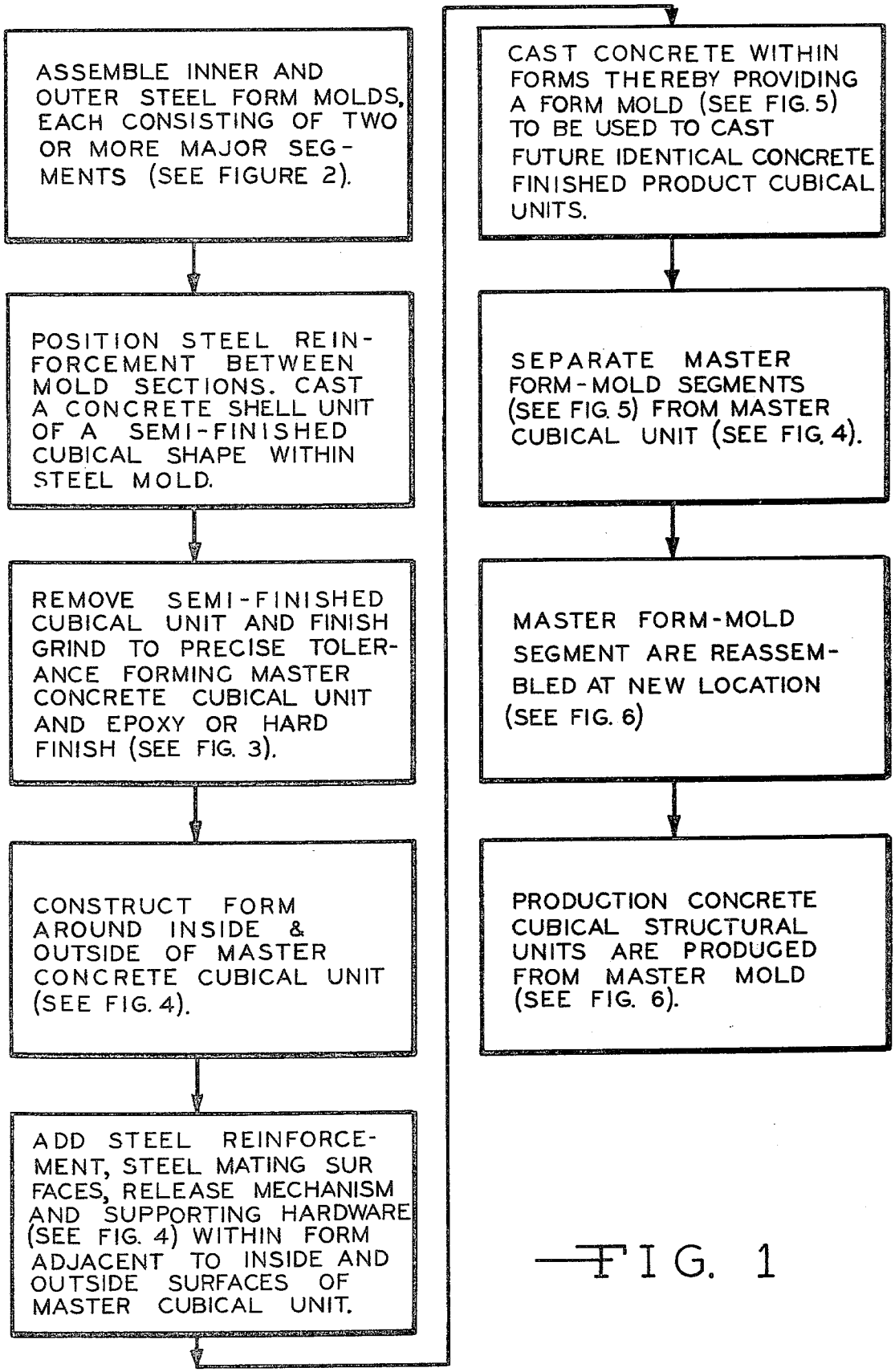
FIG. 1 is a block diagram sequentially showing the steps of the method in producing the concrete housing module mold forms of this invention.

Referring now to FIG. 1, the invention will be described both with reference to the block diagram flow chart and the various figures referenced therein. With reference to the first step and FIG. 2, practice of the invention begins with the construction of a rigid mold form of high dimensional accuracy. The mold form consists of inner and outer sections which may be fabricated of steel or other sufficiently rigid material such as reinforced and braced wood. The overall mold is designated M in FIG. 2. The mold M defines a rectangular or cubicle volume outlined formed by four perpendicular sides with open or closed ends representing the size, thickness and proportions of the final product. The size of the mold and thus the product are dictated by its application and, as previously explained, will typically measure ten feet along any axis and be utilized as a housing module. Also as previously explained, modular construction art has progressed to the state that lateral projections, such as those ribs shown about the periphery of the module in FIG. 3, are used to provide tunnels or spaces between adjacent module walls for plumbing, electrical conduit, heating ducts, etc. Provisions for such ribs may be made in the walls of the master mold M.

It is to be understood that the particular shape of the housing module shown herein does not form a part of this invention nor are the concepts of this invention limited to the production of any particular module shape. As will be understood by those skilled in the art, a typical housing module may be rectangular or cubical in nature and, when assembled in a housing unit, may be stacked one upon another or positioned adjacent each other in horizontal rows to form the desired enclosed space.

It should also be understood that when the word "cube" or "cubical" is used, it is intended to mean the cubical or box shaped unit which may have a length greater or lesser than its width or height and therefore is not, strictly speaking, a true cube which would have identical length, width and height. The "cube", or "cubical" in this context is also intended to imply that the unit is a hollow, box-like structure having four solid sides and open on the two remaining opposite sides as in FIG. 3.

Subsequent to fabrication and assembly of the master mold M, steel reinforcing rods or similar structures (not illustrated) are positioned between the inner and outer walls of the master mold M and the mold is filled with concrete or similar cementitious substance which is then allowed to harden. It will be understood by those skilled in the art that the size and quantity of steel reinforcing rods which are utilized will depend upon the size and nature of the module being formed.

The master mold M of FIG. 2 thus produces the master pattern P illustrated in FIG. 3. Once the master pattern P of FIG. 3 has been cast and removed from the master mold M, its surface is treated to correct dimensional variations and to remove unwanted blemishes by the application of an epoxy or similar sealer to the surfaces of the master pattern P, according to step 3 of FIG. 1. The ease with which dimensional corrections and minor changes to the master pattern P may be made due to its having been cast of a concrete or similar cementitious material is significant.

Referring now to step 4 of FIG. 1 and particularly to FIG. 4, the master pattern P is placed with its open ends in vertical alignment upon a suitable uniform planar support 10. An outer form 11 fabricated from, for example, steel plate, is placed about the pattern P as shown. Since the pattern P forms the critical mold surface whereas the outer form 11 does not, the dimensions of the outer form 11 are not crucial. It is, of course, important that the separation between the outer surface of the master pattern P and the inner surface of the outer form 11 be sufficiently great to imbue the mold produced thereby with adequate structural integrity. The outer form 11 may be a single unit of appropriate draft which is placed circumjacent the pattern P. Suitable tracks or grooves may also be formed in the planar support 10 to assist positioning of the outer form 11 about the pattern P. Similarly, an inner form 12 is placed within the pattern P and may be fabricated of a material and in a fashion similar to that of the outer form 11. Again, since the inner form 12 also does not itself act as a critical molding surface, its precise size and positioning is not critical beyond the consideration of forming a mold having sufficient thickness and thus structural integrity.

As is apparent from FIG. 4, the forms 11 and 12 disposed without and within the pattern P create peripheral cavities which will receive the concrete or other cementitious material which will in turn assume impressions of the exterior and interior faces of the pattern P.

Referring now to FIGS. 4 and 5, a release system is provided which significantly simplifies and speeds the final production phases of the invention. The release system comprises a plurality of pairs of parallel mold plates disposed between the inner and outer mold forms 12 and 11, respectively, and the pattern P. Two pairs of plates 15 and 16 extend diagonally between the outer form 11 and pattern P at opposite corners. Four pairs of plates denominated 17, 18, 19 and 20 are disposed perpendicularly to the inner form 12 and the pattern P and obliquely relative to and spaced somewhat from the corners of the pattern P most proximate the plates 15 and 16. The plates 15 through 20 may be fabricated of steel or similar material and sized to accurately fit between and seal against the pattern P in either the outer or inner form 11 or 12, respectively, depending upon their location. The plates 15 through 20 provide strengthened and accurately assemblable mold joints between adjacent mold segments. Preferably, suitable metal projections such as bolts, rods or anchors (not shown) extend from the plates 15 through 20 into the area where concrete will be poured to securely attach the plates thereto. Conventional reinforcing bars may also be placed within the space between the inner and outer molds 12 and 11 and the pattern P depending upon the size of the product to be cast according to conventional and accepted structural concrete techniques. In conjunction with reinforcing rods, lifting means such as preformed reinforcing rod loops or flexible wire ropes, if they are to be utilized, are also positioned within the spaces to be filled with concrete. Preferably, sections of right-angle edging (not shown) are disposed along the upper and lower marginal edges of the pattern P on its inner and outer faces. The right-angle edging may include suitable projections such as bolts or anchors (not shown) extending into the area where the concrete is to be filled to securely attach them thereinto. The right-angle segments provide reinforcement to these edges and extend the life of the mold.

Step 5 of FIG. 1 comprehends filling the space between the pattern P and the inner and outer mold forms 12 and 11, respectively, with cement or other cementitious mix which is then allowed to harden.

As delineated in FIG. 1, the next step, after this cast has hardened, is the removal of the outer form 11 and the inner form 12. As previously stated, each of the forms 11 and 12 may be provided with suitable draft to facilitate their removal. Mold release agents may also be used to facilitate removal. The resulting segmented production mold form is shown in an exploded perspective view in FIG. 5. An inner production mold form 21 comprises large right-angle inner mold segments 21*a* and 21*b* as well as corner segments 13 and 14. Due to the oblique orientation of the pairs of plates 17, 18, 19 and 20, which define the faces of corner segments 13 and 14, the sections define tapering wedges. The function of these tapering corner sections 13 and 14 will be subsequently described. The adjacent, aligned edges of the four segments 13, 14, 21*a* and 21*b* are defined by respective pairs of face plates 17, 18, 19 or 20. It should thus be apparent that the parallel pairs of face plates define oblique parting lines between sections of the inner mold and facilitate disassembly and reassembly during casting of production modules. Likewise, an outer mold form 22 comprises a pair of right-angle segments 22*a* and 22*b* which may be disassembled and accurately reassembled along the diagonal parting line defined by the pairs of parallel face plates 15 and 16. It should again be stated that these six mold form segments 12, 13, 21*a*, 21*b*, 22*a* and 22*b* need have accurately dimensioned surfaces only as to those surfaces which were formed by one face of the pattern P in the construction shown in FIG. 4 as well as at the matching planar plate locations 15 through 20. Accordingly, the configuration of the outer surface of the outer mold form 22 and the interior surface of the inner mold form 21 and corner segments 14 and 13 is not significant to the instant apparatus or process and these surfaces need not be finished or otherwise dimensioned.

It should be also noted that previously delineated step Nos. 5 through 7 of FIG. 1 may be repeated numerous times to produce numerous production molds of high dimensional accuracy. As has been previously stated, a significant feature of the instant invention is to provide multiple mold means derived from a single identical initial pattern, namely, the pattern P, which, due to their similarity, produce production modules of high dimensional accuracy.

Referring now to the eighth step delineated in FIG. 1 and specifically the apparatus illustrated in FIGS. 5 and 6, the outer mold form segments 22*a* and 22*b* which have previously been cast may be provided with an apparatus which is effective to separate the two outer mold segments 22*a* and 22*b* in a direction normal to the diagonal plane of the pair of parallel plates 15 and 16. Such an apparatus may be a sliding track arrangement upon which the mold segments 22*a* and 22*b* slide toward or away from each other, driven by force generating devices such as a pair of hydraulic cylinders connected at one end to this simple mechanism is effective to withdraw the outer mold segments 22*a* and 22*b* away from the pattern P or during the production stage, away from a cast concrete module.

Referring now briefly to FIGS. 5 and 9, means for securing the two segments of the outer mold 22 are illustrated. The outer mold segments 22*a* and 22*b* as well as the pairs of plates 15 and 16 are provided with a plurality of apertures and threaded fasteners 24 extending therethrough. Installation of the threaded fasteners 24 through the apertures provide simple and precise matching of the mold segments 22*a* and 22*b* as well as providing a quick release means. A simple threaded fastener assembly is illustrated in detail in FIG. 9.

Referring now to FIGS. 6, 7 and 8, the apparatus for releasing the inner mold form segments 21*a* and 21*b* and inclined corner segments 13 and 14 during both production of the mold and the modules includes a plurality of guide slots 25 disposed in one of each pair of parallel plates 17, 18, 19 and 20 which cooperate with a like plurality of fastener assemblies 26 which include at least one shoulder washer or similar assembly for maintaining intimate contact between the pairs or parallel plates while permitting relative motion therebetween along the length of the guide slots 25. The mechanism utilized to produce such relative motion preferably includes a mechanical force device such as a fluid powered cylinder 27, two of which may be utilized in opposite corners of the inner mold and disposed adjacent the corner segments 13 and 14. Each of the fluid powered cylinders 27 is linked through a conventional yoke assembly 28 to a flange 29 which is embedded within a respective corner segment 13 or 14 and extends inwardly therefrom into engagement with the yoke assembly 29 of the fluid powered cylinder 27. A guide track 30 is preferably provided adjacent the fluid powered cylinder 27 and ensures accurate inward and upward movement of the corner segments 13 and 14 as the fluid powered cylinders 27 is activated and extended. The overall cooperation of the fluid powered cylinders 27, corner segments 13 and 14, inner mold forms 21*a* and 21*b* and threaded fasteners 26 and the guide slots 25 should thus be apparent.

Referring now briefly to FIG. 10, one embodiment of a roller and track mechanism 31 which may be used to support and guide movement of the outer mold forms 22*a* and 22*b* between their open and closed positions is illustrated. The roller and track mechanism 31, in cooperation with the fluid powered cylinders 23 provide accurate and rapid positioning of the outer mold forms 22*a* and 22*b*.

To use the apparatus illustrated in FIG. 6, the interior cylinders 27 are retracted so that the interior corner inclined mold form segments 14 and 13 move to their lower closed position to form the enclosed inner mold assembly (FIG. 6). The cylinders 23 are extended to close the outer mold form halves 22*a* and 22*b*. The fasteners 24 for the outer mold form halves are applied and the suitable release material, etc., is applied to the mold form faces. The desired reinforcing bars and attachment devices are positioned within the space between the mold forms and a hardenable mixture is cast therein. As soon as this mixture has set, the reverse procedure is applied to open the outer mold forms 22*a* and 22*b*, contract the inner mold forms 13, 14, 21*a* and 21*b* so that the production concrete module cast therein can be removed by lifting it vertically out of the mold forms. It has been found that with careful casting techniques, practically no finishing of the production concrete module is required and, because of the method in which the mold forms have been produced, that there is zero or very little dimensional variation between the respective production concrete modules, thus enabling their use in a given project from a number of different mold form assemblies or production sources.

The foregoing disclosure is the best mode devised by the inventor for practicing this invention. It is apparent, however, that methods incorporating modifications and variations to the instant invention will be obvious to one skilled in the art of manufacturing concrete structural modules. Inasmuch as the foregoing disclosure is intended to enable one skilled in the pertinent art to practice the instant invention, it should not be construed to be limited thereby but should be construed to include such aforementioned obvious variations and be limited only by the spirit and scope of the following claims.

What I claim is:

1. Apparatus for casting dimensionally uniform cementitious modules comprising, in combination, two outer mold segments separable along a diagonal parting plane, each of two said outer mold segments having two mold walls orientated substantially normal to each other, said two outer mold segments fabricated of cast, cementitious material and defining two pairs of first parallel faces, each of said pair of faces disposed parallel to and on opposite sides of said parting plane, two pairs of first metallic, parallel plates, one of each of said pairs of first plates anchored to said cementitious material and disposed on a respective one of said pairs of first faces and defining abutting outer mold segment surfaces, means for releasably securing said two outer mold segments to one another, four inner mold segments separable along four oblique parting planes each of said four inner mold segments having two mold walls orientated substantially normal to one another, said four inner mold segments fabricated of cast, cementitious material and defining four pairs of parallel second faces, disposed parallel to and on opposite sides of a respective one of said oblique parting planes, four pairs of second metallic, parallel plates one of each of said pairs of second plates anchored to said cementitious material and disposed on a respective one of said pairs of second faces and defining abutting inner mold segment surfaces, and means for releasably securing said inner mold segments.

2. The apparatus of claim 1, further including means cooperating with said means for releasably securing said inner mold segments for translating two of said inner mold segments generally along an axis parallel to said oblique planes defining said respective mold segments.

3. The apparatus of claim 1, further including hydraulic cylinder means for selectively moving said outer mold segments normal to said diagonal parting plane.

4. The apparatus of claim 2, wherein said translating means includes a hydraulic cylinder for selectively moving said two of said four inner mold segments.

5. The apparatus of claim 1 wherein said means for releasably securing said two outer mold segments to one another includes a plurality of aligned apertures defined in said pairs of first plates and fastener means extending through said apertures for securing said pairs of plates in justaposition.

6. The apparatus of claim 1 wherein said means for releasably securing said four inner mold segments includes a plurality of aligned apertures defined in said pairs of second plates and fastener means extending through said apertures for securing said pairs of plates in juxtaposition.

* * * * *

UNITED STATES PATENT AND TRADEMARK OFFICE

CERTIFICATE OF CORRECTION

PATENT NO. : 4,300,746

DATED : November 17, 1981

INVENTOR(S) : John F. Schoen

It is certified that error appears in the above-identified patent and that said Letters Patent are hereby corrected as shown below:

Page 1, in the title, delete the words "AND METHOD";

IN THE DRAWINGS

In Figure 2, the form should be designated by the letter M.

In Figure 4, the numeral "17" on the left of the drawing should be -- 15 --.

In Figure 5, the numeral "13" should be -- 14 --.

In Figure 5, the numeral "12" should be -- 13 -- and the arrow on the associated leader should be deleted.

In Figure 5, the numeral "15" in the upper right portion of the drawing should be -- 16 -- and the arrow on the associated leader should be deleted.

In Figure 5, the arrow on the leader associated with the numeral 15 should be deleted.

In Figure 5, the numeral "21" should be -- 21a --.

In Figure 5, the numeral 21b should be added to the form segment directly behind the segment labeled 21a and both segments should be identified by the addition of the numeral 21 with a leadered arrow.

UNITED STATES PATENT AND TRADEMARK OFFICE

CERTIFICATE OF CORRECTION

PATENT NO. : 4,300,746

DATED : November 17, 1981

INVENTOR(S) : John F. Schoen

It is certified that error appears in the above-identified patent and that said Letters Patent are hereby corrected as shown below:

In Figure 5, the numeral 22 should be deleted from the form segment 22a and both segments should be identified by the addition of the numeral 22 with a leadered arrow.

In Figure 6, the numeral "13" should be -- 14 --.

In Figure 6, the numeral "12" should be -- 13 --.

In Figure 6, the numeral "17" in the upper left portion of the drawing should be -- 15 --.

In Figure 6, the numeral "17" in the lower right portion of the drawing should be -- 16 --.

Signed and Sealed this

Sixth Day of July 1982

[SEAL]

Attest:

GERALD J. MOSSINGHOFF

Attesting Officer

Commissioner of Patents and Trademarks